US011219817B2

(12) United States Patent
Svendsen et al.

(10) Patent No.: US 11,219,817 B2
(45) Date of Patent: Jan. 11, 2022

(54) MOVING MECHANISM FOR A SKI BINDING

(71) Applicant: ROTTEFELLA AS, Klokkarstua (NO)

(72) Inventors: Oyvar Svendsen, Oslo (NO); Thomas Goverud-Holm, Hoff (NO); Jorn Frode Danielsen, Drobak (NO)

(73) Assignee: ROTTEFELLA AS, Klokkarstua (NO)

( * ) Notice: Subject to any disclaimer, the term of this patent is extended or adjusted under 35 U.S.C. 154(b) by 94 days.

(21) Appl. No.: 16/618,202

(22) PCT Filed: May 29, 2018

(86) PCT No.: PCT/NO2018/050140

§ 371 (c)(1),
(2) Date: Nov. 29, 2019

(87) PCT Pub. No.: WO2018/222049

PCT Pub. Date: Dec. 6, 2018

(65) Prior Publication Data

US 2021/0154561 A1 May 27, 2021

(30) Foreign Application Priority Data

May 30, 2017 (NO) ..... 20170891

(51) Int. Cl.
*A63C 9/00* (2012.01)
*A63C 9/088* (2012.01)
(Continued)

(52) U.S. Cl.
CPC ..... *A63C 9/005* (2013.01); *A63C 9/003* (2013.01); *A63C 9/0053* (2019.05); *A63C 9/088* (2013.01);
(Continued)

(58) Field of Classification Search
CPC ..... A63C 9/003; A63C 9/005; A63C 9/0053; A63C 9/088; A63C 9/20; A63C 9/086
See application file for complete search history.

(56) References Cited

U.S. PATENT DOCUMENTS

2003/0085549 A1 5/2003 Gorza et al.
2003/0151230 A1* 8/2003 Lucas ..... A63C 9/005 280/613
(Continued)

FOREIGN PATENT DOCUMENTS

EP 1226849 A2 7/2002
EP 2624924 A1 8/2013
(Continued)

OTHER PUBLICATIONS

International Search Report PCT/ISA/210 for International Application No. PCT/NO2018/050140 dated Oct. 10, 2018.
(Continued)

*Primary Examiner* — Brian L Swenson
(74) *Attorney, Agent, or Firm* — Harness, Dickey & Pierce, P.L.C.

(57) ABSTRACT

An attachment mechanism for a locking element to be fastened to a mounting plate on a cross-country ski. The ski comprises the mounting plate on a top surface of the ski. The mounting plate comprises side edges having an undercut profile for placement and attachment of a binding or binding component via a complementary profile thereon, and a channel that accommodates a slide member. The slide member top side comprises at least one locking element. The underside of the binding or binding component comprises at least one complementary locking element. The locking element comprises a plate. The plate underside includes downward projecting legs. The legs are spaced apart at a distance substantially corresponding to a width of the channel. The mounting plate on each side of the channel com-
(Continued)

Figure 1A:
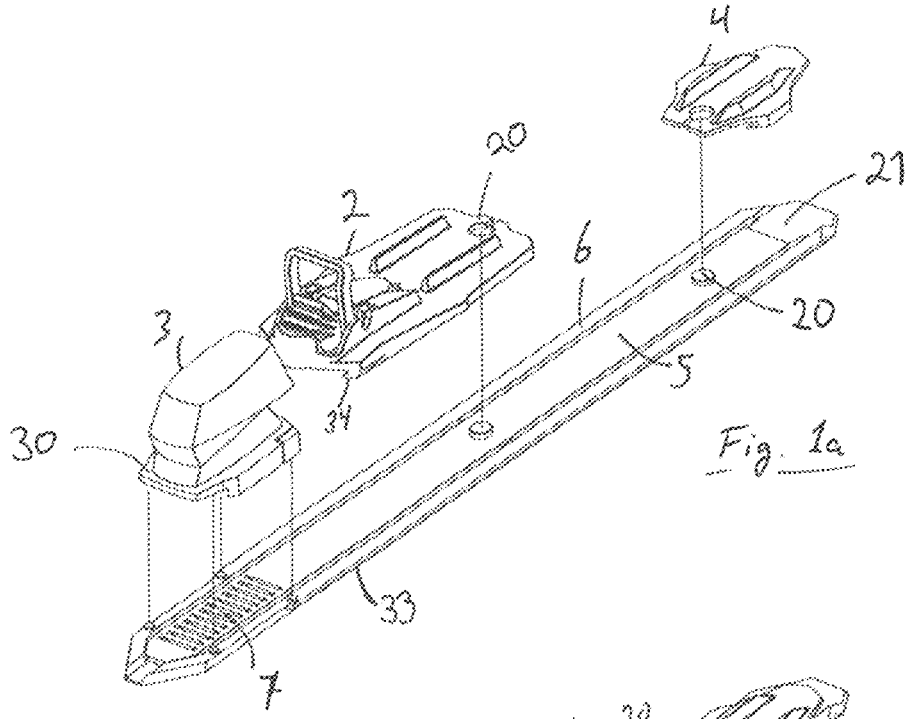

prises openings adapted to receive the legs. The mounting plate and the legs comprise holes adapted to receive one or more bayonets.

7 Claims, 7 Drawing Sheets

(51) Int. Cl.
*A63C 9/086* (2012.01)
*A63C 9/20* (2012.01)

(52) U.S. Cl.
CPC ..... *A63C 9/086* (2013.01); *A63C 9/20* (2013.01); *A63C 2009/008* (2013.01)

(56) References Cited

U.S. PATENT DOCUMENTS

| | | | | |
|---|---|---|---|---|
| 2003/0193171 | A1 | 10/2003 | Krumbeck et al. | |
| 2006/0103113 | A1 | 5/2006 | Guyot et al. | |
| 2008/0002998 | A1 | 1/2008 | Goto et al. | |
| 2011/0025003 | A1* | 2/2011 | Moore | A63C 9/086 280/11.33 |
| 2019/0381388 | A1* | 12/2019 | Fellin | A63C 9/0807 |

FOREIGN PATENT DOCUMENTS

| | | | |
|---|---|---|---|
| NO | 327573 | B1 | 8/2009 |
| NO | 335244 | B1 | 10/2014 |
| NO | 20150320 | A1 | 9/2016 |
| WO | WO-88/04563 | A1 | 6/1988 |
| WO | WO-2012/045723 | A1 | 4/2012 |
| WO | WO-2015/140258 | A1 | 9/2015 |
| WO | WO-2015/150216 | A1 | 10/2015 |

OTHER PUBLICATIONS

Norwegian Search Report for Norwegian Patent application No. 20170891 dated Dec. 22, 2017.
Written Opinion of the International Searching Authority PCT/ISA/237 for International Application No. PCT/NO2018/050140 dated Oct. 10, 2018.
English-language translation of Chinese Office Action dated Apr. 27, 2021 for corresponding Chinese Application No. 201880035519.X.

* cited by examiner

MOVING MECHANISM FOR A SKI BINDING

CROSS-REFERENCE TO RELATED APPLICATIONS

This application is a national phase under 35 U.S.C. § 371 of PCT International Application No. PCT/NO2018/050140 which has an International filing date of May 28, 2018, which claims priority to Norwegian Patent Application No. 20170891, filed May 30, 2017, the entire contents of each of which are hereby incorporated by reference.

The present invention relates to a mounting system for a binding, or parts thereof, on a cross-country ski. More specifically, the invention relates to an attachment mechanism for a locking means to be fastened to a mounting plate on a cross-country ski.

NO335244 and NO327573 relate to a mounting plate for attachment of a binding to a ski, primarily a cross-country ski. The mounting plate is glued to the upper surface of a ski and comprises longitudinal side edges having an undercut profile for longitudinal placement and attachment of the binding or binding components by means of a complementary profile. The mounting plate has a stiffness that to a small degree affects the rigidity and properties of the skis. By means of this mounting plate a binding may be mounted on a ski without the use of screws, glue or other tools, thus avoiding a puncturing of the seal around the core of a ski. In addition, the mounting plate is advantageous for dealers because the mounting process requires a minimum of qualifications and is fully reversible. For the end user the mounting plate is favorable because the ski may be adapted to a greater degree to body weight, skill, and snow- or waxing conditions.

EP2624924 relates to a binding that enables manual longitudinal movement of a binding on a ski.

Figure 6:
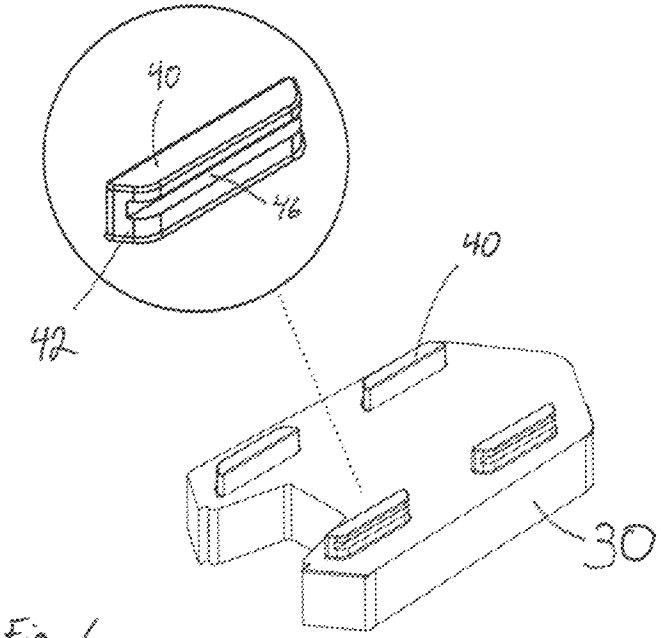

FIG. 6 shows an embodiment where a mover mechanism is arranged on a mounting plate on a ski, where the mover mechanism comprises a screw knob. By rotation of the screw knob 180 degrees the binding is moved forward or backward, respectively.

WO 2015140258 A1 shows a method for attaching a movable binding plate to a cross-country ski.

US 2006/0103113 A1 and US 20080029998 A1 show various attachments and binding plates for alpine skis.

EP 1226849 A2 shows a binding for alpine skis having binding plates at the front and rear that are movable on a ski by means of levers connected to a gear.

NO20150320 relates to an invention that offers totally new possibilities in the ski sport. NO20150320 discloses a binding system for optional dynamic longitudinal positioning of a binding on cross-country skis by means of an electric actuator, an energy source and a control system. This dynamic system enables a skier, inter alia, to change the position of the binding while in motion such that, in practice, one obtains a gearing system that makes it easier and faster to go forward. Such a dynamic binding system may be mounted on or in a ski by means of a mounting plate, but the aforementioned existing mounting plates are not well suited for such expanded functionality.

A dynamic binding system as mentioned above would typically include a ski, a binding 2; 4, a mounting plate 6, a slide member 5 and a motor/electronics 3 (in an electric version) or some form of handle/lever/switch knob 29; 9, 10, 12 or the like (in a manual version). As mentioned above, the mounting plate 6 is arranged on an upper surface of the ski. Mounting plate 6 will in one embodiment comprise longitudinal side edges having an undercut profile 33 for longitudinal placement and attachment of a binding 2 or binding component 4 by means of a complementary profile in the binding or binding component. Further, the mounting plate 6 will typically comprise a longitudinal channel 21 that accommodates a longitudinal slide member 5, where the upper surface of slide member 5 comprises at least one locking means 20, while the underside of the binding or binding component comprises at least one complementary locking means. This setup results in a system whereby binding 2 or binding component 4, which is securely locked to slide member 5 with the aid of at least one complementary locking means, may be pushed more or less freely back and forth on mounting plate 6, while the binding 2 or binding component 4 engages with and is held down on/over mounting plate 6 by means of said longitudinal side edges/undercut profile 33 and the complementary profile 34 of binding 2 or binding component 4. To securely hold slide member 5, and thereby binding 2 or binding component 4, in the desired longitudinal position, there is required a locking means that locks the longitudinal movement of slide member 5 relative to mounting plate 6, and therewith also the ski. This locking means must be fastened to mounting plate 6 or to the ski by means of an attachment mechanism.

An objective of the invention is to provide a mounting system that is suited for a dynamic binding system where the binding may be moved while the skier is in motion.

A second objective of the invention is to provide a mounting system that is also suited for a binding system where the binding may be moved manually.

A further objective of the invention is to provide a mounting system that is suited for a range of binding types, both movable and fixed.

An additional objective of the invention is to provide a mounting system that is suited for a range of binding types from different producers and/or for various areas of use.

A further objective of the invention is to provide a mounting system that offers the possibility of supplementing a binding system with a different and new functionality.

These and other objectives are attained by means of a mounting system according to the attached claim 1. Additional advantageous features and embodiments are disclosed in the dependent claims.

Figure 1B:
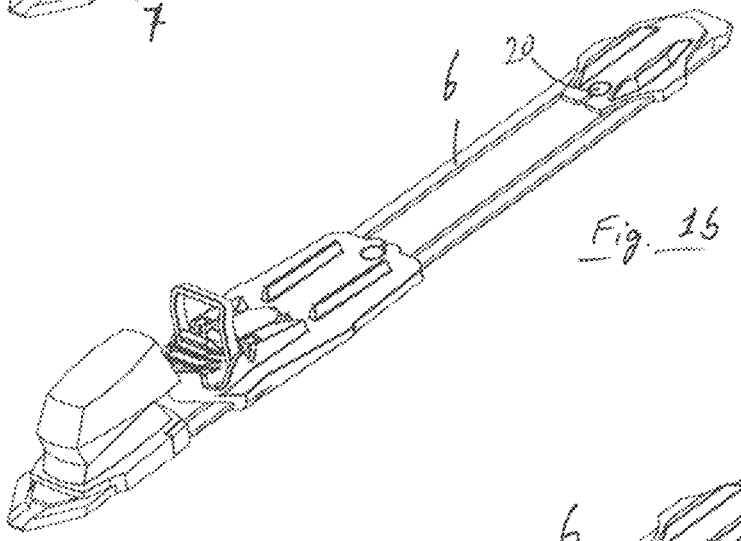
Figure 1C:
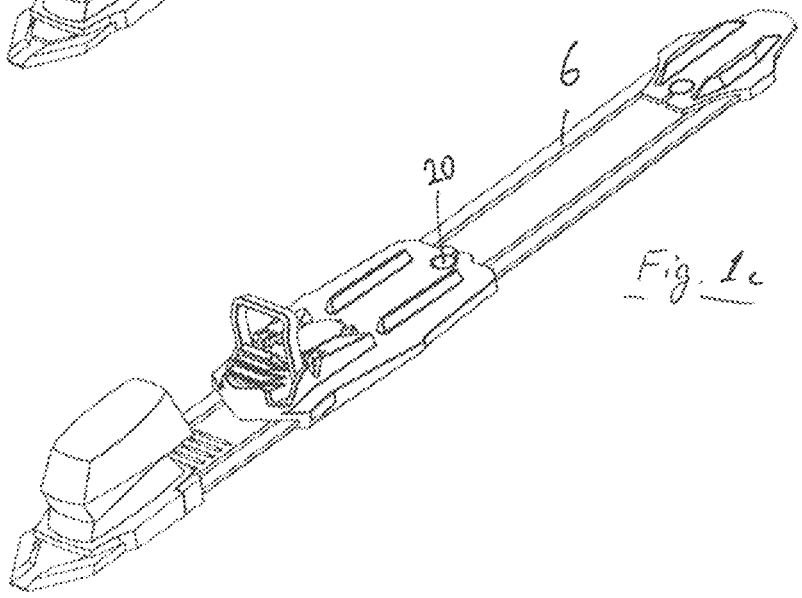
Figure 2:
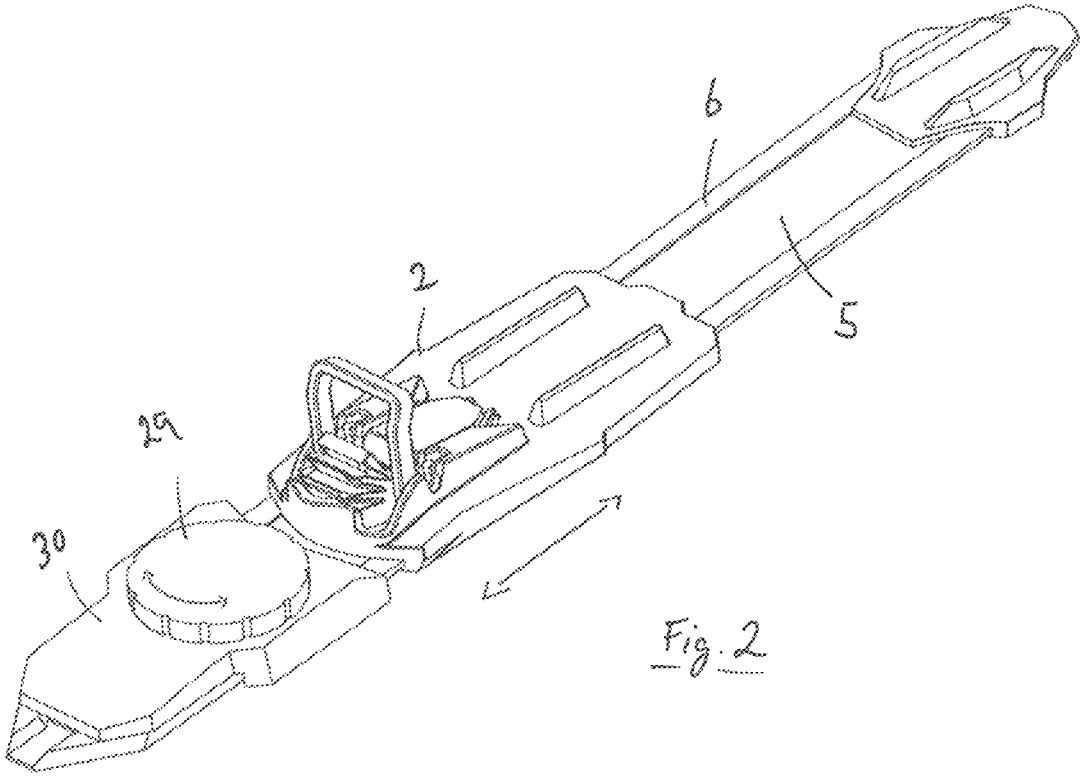
Figure 3:
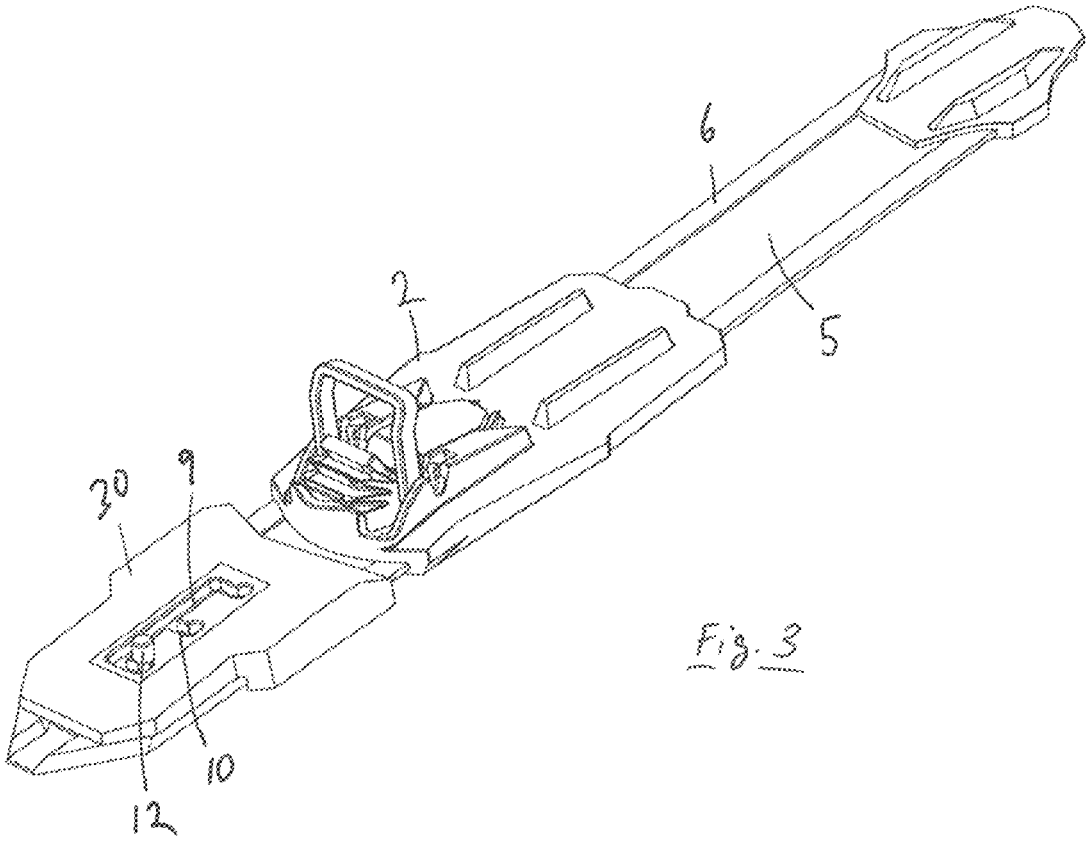
Figure 4:
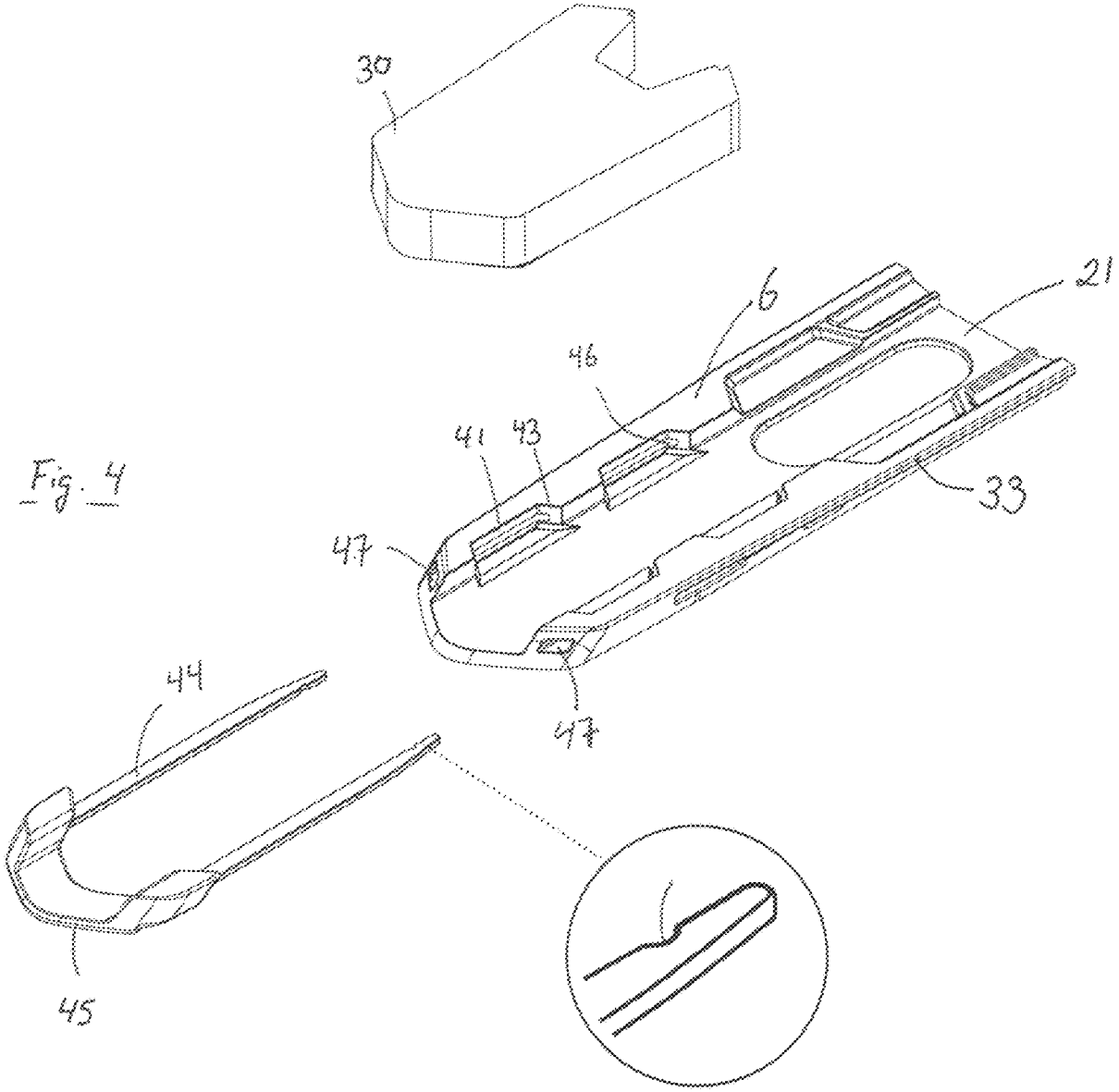
Figure 5:
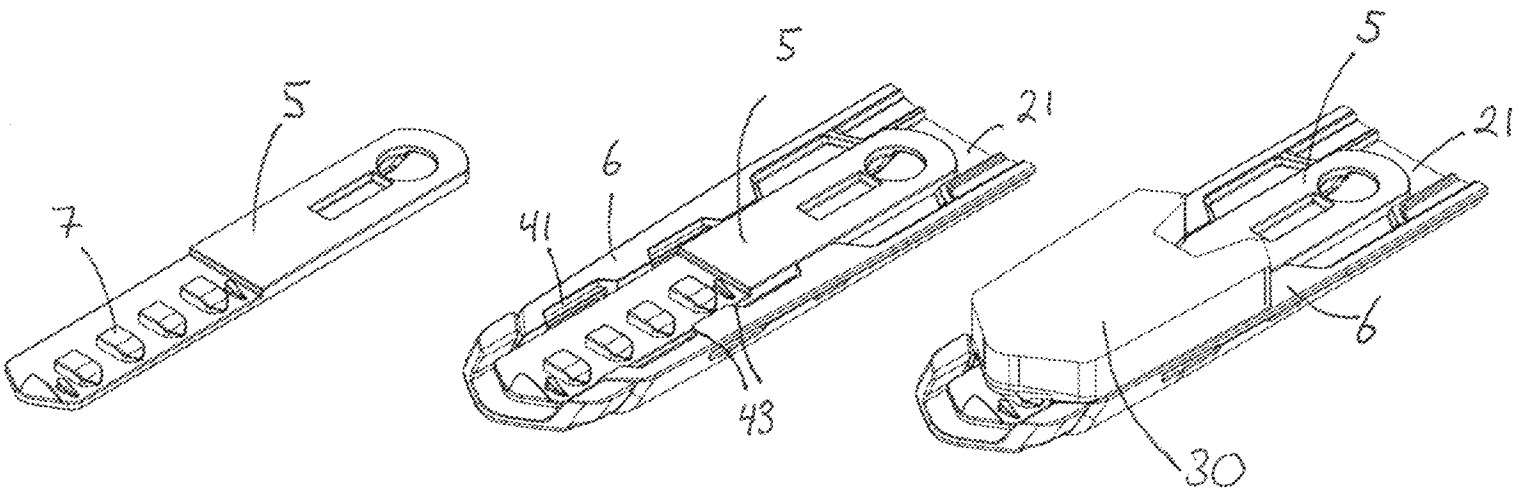
Figure 7:
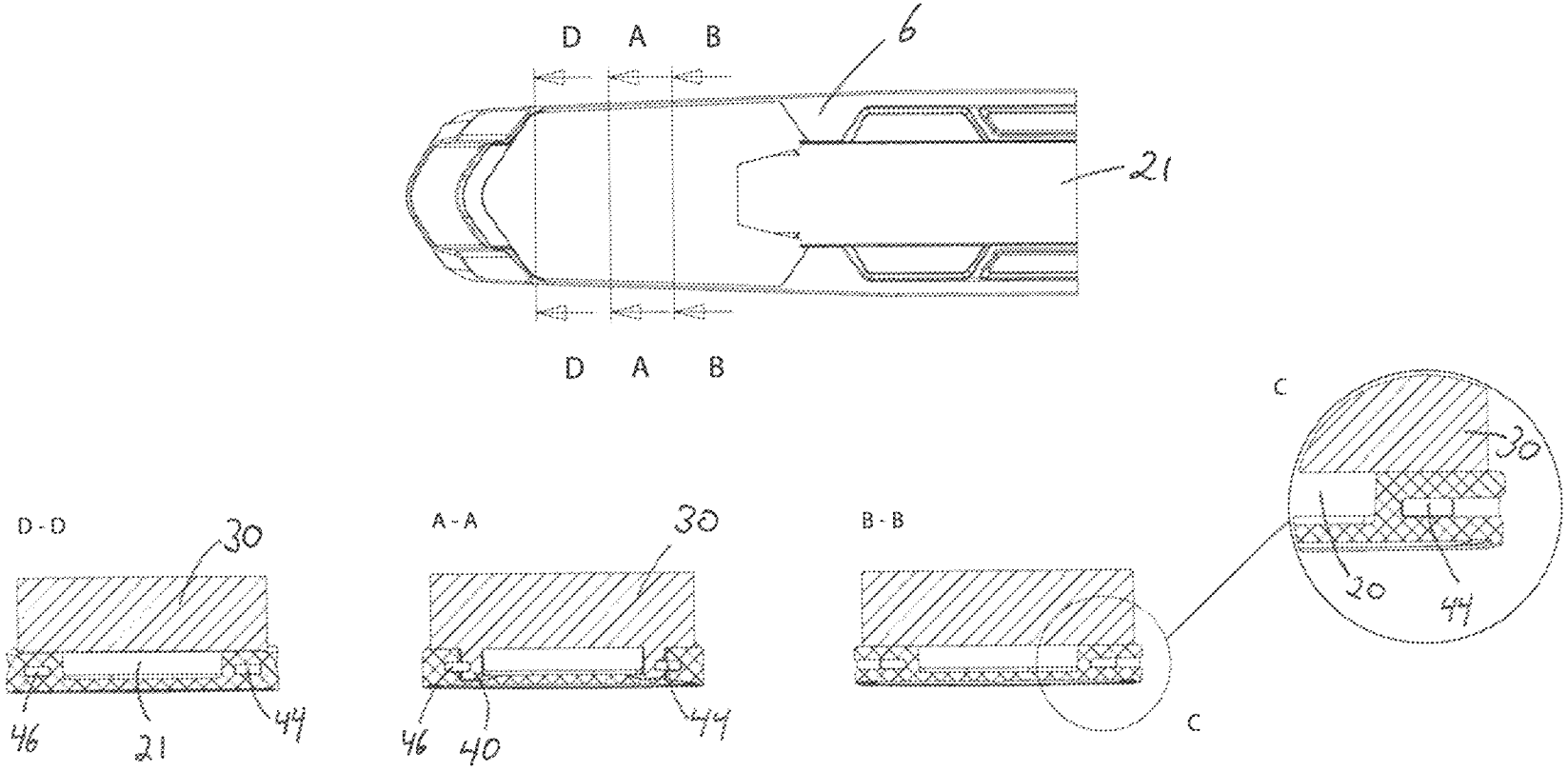

In the following is given a non-limiting description of advantageous embodiments, with reference to the figure drawings, where FIG. 1*a-c* shows an embodiment of a system comprising a ski (not shown), a mounting plate having a channel, a binding or binding component, a slide member and a locking means. In this embodiment an electric motor is used to move and lock, respectively, the slide member/binding/binding component in the desired position, FIG. 2 shows an embodiment of a manual system comprising a screw knob, FIG. 3 shows an embodiment of a manual system comprising a push handle, FIG. 4 shows an embodiment of the invention where a slide member is not shown, FIG. 5 shows an embodiment of the invention having a slide member, FIG. 6 shows the locking means comprising legs projecting from the underside, and FIG. 7 shows an embodiment of the invention with 3 cross-sections and one segment section, FIG. 6 shows a locking means comprising a plate 30 having four legs 40. The legs 40 fit down into four complementary openings 41 in a mounting plate (FIGS. 4 and 5), two openings 41 on each side of a longitudinal channel 21. The legs 40, openings 41 and channel 21 are formed so as to provide sufficient space for a slide member 5. The legs 40 are thus arranged to straddle the channel 21/slide member 5.

The locking means may comprise parts and equipment offering varying functionality. In one solution the locking means may comprise a locking mechanism that ensures that the slide member 5 over which it straddles is locked securely, preventing any form of displacement whatsoever without the complete removal of the locking means. Such a locking mechanism may comprise, e.g., a pin or grooves/ridges projecting downward from the underside of the plate (in the area between legs 40) and into complementary holes or slots in the slide member. Other ways of locking the slide member against movement in the longitudinal direction may be readily envisaged.

In a second solution the locking means may be equipped with a manual mover mechanism that permits step-by-step or continuous back and forth movement of the slide member, e.g., a screw knob, handle, switch, or the like, ref. FIGS. 2 and 3. In such an embodiment the intention is to enable adjustment of the longitudinal position of a binding 2, 4 on a ski by manipulating the manual mover mechanism 29; 9, 10, 12. This embodiment has a functionality corresponding to that shown in EP2624924, FIG. 6, mentioned above. While said embodiment shows two locked positions, the manual mover mechanism may well also be designed so as to be adjustable between more than two stepwise positions (or continuous positions). In any case, the point is that the mover mechanism shall securely hold the slide member (and thereby the binding) in a selected position, step-by-step or continuously, so that the binding position is not displaced in an undesirable way between each manual adjustment.

In a third solution the locking means may be equipped with an automatic mover mechanism, e.g., an electric motor including auxiliary electronics (transmitter/receiver, electronic chip, battery, various sensors, gyro, GPS, etc.). In this embodiment, for example, a gear (not shown) or corresponding power transfer means may project downward below the plate and engage with the upper surface 7 of slide member 5. By actuation of, e.g., an electric motor 3, the gear wheel can rotate in such a way that slide member 5, and thereby binding 2, 4, is moved forward and back. In such an embodiment the upper surface of the slide member will necessarily comprise parts and components 3 having a certain volume and size (battery, motor, etc.).

There are also other conceivable solutions, where plate 30 is provided with a different functionality, e.g., a light, a decoration, a release mechanism, etc.

No matter which of the aforementioned solutions are relevant, the locking means will completely or partially absorb longitudinal forces from the binding 2, 4. When binding 2, 4 is in the desired longitudinal position and the skier is in motion on the ski, the forces from the kick will be transferred via binding 2, 4 and slide member 5 to the locking means, i.e., the mechanical part or parts that grip down into slide member 5 from the locking means (pins, grooves/ridges, gear wheels, or the like). These forces will then be transferred further via the legs 40 of the locking means, the openings 41 in the mounting plate and on to the mounting plate 6/the ski. It is therefore important that the attachment mechanism between the locking means and the mounting plate 6 is reliable.

The attachment mechanism between the locking means and the mounting plate must fulfil a number of requirements and needs: It must provide a reliable and secure anchor which cannot be damaged or broken during ordinary use. It must be free of undesirable slackness or play. It must function under difficult temperatures and snow conditions (extreme cold, icing, etc.). It should be easy to operate, preferably without tools, under difficult temperature and snow conditions. It must tolerate blows, twisting, weight, clamping forces, etc. It must also be designed to facilitate the exchange between parts and components that enables the altering of functionality, e.g., in the form of upgrading from manual to automatic functionality, changing out worn parts, maintenance, etc.

According to one possible embodiment of the invention, the legs 40 have a longitudinal extent that is greater than the width, with the legs at the front edge and the rear edge forming a (sloping) shoulder surface 42 which abuts against complementary shoulder surfaces 43 formed in the openings 41 in mounting plate 6. An example of this is shown in FIGS. 4 and 6. The mentioned longitudinal forces are taken up by these shoulder surfaces 42, 43. The angle of the shoulder surfaces 42, 43 is probably not critical, but may be selected so as to facilitate the assembly/disassembly, to reduce play, to provide an attractive design, or the like. In any case, legs 40, openings 41 and shoulder surfaces 42, 43 must be dimensioned such that the strength is (more than) sufficient to tolerate the forces and wear to which the system is exposed.

To lock the attachment mechanism securely, a locking key is included in the form of two slide members/bars (bayonets 44) that may be passed through openings 47 in the front edge of the mounting plate and into complementary holes 46. In the embodiment shown, the bayonets 44 are made of metal and are fastened together by means of a bridge 45 between the front ends of the bayonets 44. It is understood that bayonet(s) 44 may be constructed from different types of materials or combinations of materials, e.g., plastic material, fiber material, metal, etc. The bayonet 44 may have various forms, e.g., mainly flat and straight (a blade), or rounded, angular, etc. A possible alternative would be a U-shaped bail formed from a sufficiently rigid wire or the like, where the arms of the bail may be inserted into complementary holes 46 in the front edge of the mounting plate. The holes 46 pass through mounting plate 6 and openings 41 in a longitudinal direction, while legs 40 can comprise slots, holes or a profile running precisely in register/alignment with holes 46 passing through mounting plate 6. When legs 40 are positioned as they should be, down in the complementary openings 41 in mounting plate 6, the bayonets 44 can be inserted into holes 46, through legs 40 and further into mounting plate 6, to securely fasten the locking means to mounting plate 6 with the aid of the attachment mechanism comprising plate 30, legs 40, openings 41 and bayonets 44. With this embodiment the longitudinal forces will be completely or partially transferred from legs 40 to mounting plate 6 via shoulder surfaces 42, 43, and forces in all other directions will be completely or partially taken up by the bayonets 44.

Although the presently described embodiment shows four legs 40 and four complementary openings 41, it would probably be sufficient to have two legs and two complementary openings 41 for most applications. However, four legs 40 provide greater stability if plate 30 is equipped with many and/or larger components 3.

Definition of Terms locking means: a device serving to prevent slide member 5, and thereby binding 2 or binding components 4, from being displaced in a longitudinal direction, longitudinal direction: the direction defined by the longitudinal direction of the ski, transverse direction: all directions crosswise to the longitudinal direction (including horizontally straight upward from the surface/mounting plate on the ski), attachment mechanism: a mechanism serving to fasten/lock the locking means securely to the mounting plate 6/the ski, longitudinal hole 46: completely or partially closed hole extending from openings 47 in the front edge of the mounting plate on each side of channel 21, through mounting plate 6 on each side of channel 21, out into and through openings 41 on each side of channel 21 (openings 41 adapted to receive at least two legs 40 of the locking means), and further into and through mounting plate 6 on each side of channel 21. The at least two legs 40 of the locking means also comprise completely or partially closed holes 46 extending in a longitudinal direction in alignment with holes 46 in mounting plate 6.

plate 30: a base forming a bridge between said legs 40. Plate 30 may comprise one or more parts, holes, recesses, framework structure, cover, etc. The plate may be flat (2-D) or have a 3-D form.

The present invention thus provides an attachment mechanism for a locking means to be fastened to a mounting plate on a cross-country ski, where the cross-country ski comprises a mounting plate 6 arranged on a top surface of the ski, where the mounting plate 6 comprises longitudinal side edges having an undercut profile 33 for longitudinal placement and attachment of a binding or a binding component 2; 4 by means of a complementary profile 34 on the binding or binding component 2; 4, where mounting plate 6 comprises a longitudinal channel 21 that accommodates a longitudinal slide member 5, where the top side of slide member 5 comprises at least one locking means 20; 23, and where the underside of the binding or binding component 2; 4 comprises at least one complementary locking means.

The present invention further provides a locking means comprising at least one plate 30 having a top side and an underside, where the underside of the at least one plate 30 is provided with at least two downward projecting legs 40, where the at least two downward projecting legs 40 are spaced apart at a distance substantially corresponding to the width of channel 21, where mounting plate 6 on each side of channel 21 comprises openings 47 adapted to receive the at least two downward projecting legs 40, where mounting plate 6 and the at least two downward projecting legs 40 comprise longitudinal holes 46, and where the holes are adapted to receive one or more bayonets 44.

According to one embodiment of the invention, an attachment mechanism is provided where the underside of plate 30 comprises at least one complementary locking means between legs 40, where the at least one complementary locking means is adapted to come into locking engagement with the at least one locking means 7 on slide member 5.

According to a second embodiment of the invention, an attachment mechanism is provided where the underside of plate 30 comprises a power transfer means that in part is adapted to move the slide member 5 in a longitudinal direction and in part is adapted to lock slide member 5 in a longitudinal direction.

The power transfer means may comprise a gear wheel.

The power transfer means is capable of engaging with slots/notches 7 in the slide member.

The slots/notches 7 in the slide member may form a toothed bar.

The top side of plate 30 may comprise components selected from the group including: twist lever 19, handle 12, switch, motor 3, sensor, battery, electronic chip, signal receiver, signal transmitter.

Instead of two bayonets, it is conceivable that legs 40 on the one side are snapped down into openings 41, while legs 40 on the other side are locked by means of only one bayonet 44 on one side.

It is also understood that each leg 40 may be divided into two or more parts, without this having any real significance for the function.

The invention claimed is:

1. An attachment mechanism for a locking means to be fastened to a mounting plate on a cross-country ski, where the cross-country ski comprises the mounting plate arranged on atop surface of the cross-country ski, where the mounting plate comprises longitudinal side edges having an undercut profile for longitudinal placement and attachment of a binding or a binding component by means of a complementary profile on the binding or binding component, where the mounting plate comprises a longitudinal channel that accommodates a longitudinal slide member, where a top side of the longitudinal slide member comprises at least one locking means, where an underside of the binding or binding component comprises at least one complementary locking means, wherein the locking means comprises at least one plate having a top side and an underside, where the underside of the at least one plate is provided with at least two downward projecting legs, where the at least two downward projecting legs are spaced apart at a distance substantially corresponding to a width of the longitudinal channel, where the mounting plate on each side of the longitudinal channel comprises openings adapted to receive the at least two downward projecting legs, where the mounting plate and the at least two downward projecting legs comprise longitudinal holes, and where the longitudinal holes are adapted to receive one or more bayonets.

2. The attachment mechanism according to claim 1, where the underside of the at least one plate comprises at least one complementary locking means between the at least two downward projecting legs, where the at least one complementary locking means is adapted to come into locking engagement with the at least one locking means on the longitudinal slide member.

3. The attachment mechanism according to claim 1, where the underside of the at least one plate comprises a power transfer means that in part is adapted to move the longitudinal slide member in a longitudinal direction and in part is adapted to lock the longitudinal slide member in the longitudinal direction.

4. The attachment mechanism according to claim 3, where the power transfer means is a gear wheel.

5. The attachment mechanism according to claim 3, where the power transfer means engages with slots/notches in the longitudinal slide member.

6. The attachment mechanism according to claim 5, where the slot/notches in the longitudinal slide member form a toothed bar.

7. The attachment mechanism according to claim 1, where the top side of the at least one plate comprises components selected from a group including: twist lever, handle, switch, motor, sensor, battery, electronic chip, signal receiver, signal transmitter.

* * * * *